United States Patent [19]

Martin et al.

[11] Patent Number: 4,485,649

[45] Date of Patent: Dec. 4, 1984

[54] ROLLING MILL CONTROL SYSTEM

[75] Inventors: Stephen Martin, Sheffield; Roy Clegg, Rotherham, both of England

[73] Assignee: Davy McKee (Sheffield) Limited, Sheffield, England

[21] Appl. No.: 434,719

[22] Filed: Oct. 15, 1982

[30] Foreign Application Priority Data

Oct. 16, 1981 [GB] United Kingdom ..... 8131276

[51] Int. Cl.[3] ..... B21D 37/00

[52] U.S. Cl. ..... 72/10; 72/20; 72/245

[58] Field of Search ..... 72/10, 16, 20, 35, 245, 72/366; 100/46; 364/472

[56] References Cited

FOREIGN PATENT DOCUMENTS 47802 2/1978 Japan ..... 72/245

*Primary Examiner*—Lowell A. Larson
*Assistant Examiner*—Jorji M. Griffin
*Attorney, Agent, or Firm*—Schwartz & Weinrieb

[57] ABSTRACT

A rolling mill having hydraulic cylinders in each housing to adjust the roll gap is provided with a control system whereby a workpiece is kept on a central path through the mill and is prevented from wandering from this path towards one of the mill housings. The system includes a pair of circuits and a connector between the circuits for averaging the load on each housing and controlling the roll gap in accordance with a certain mill stretch factor. The difference between the loads is also obtained and a signal, in accordance with a different stretch factor, is applied to the housing with the heaviest load and a signal of the same magnitude, but opposite polarity, is applied to the other housing.

12 Claims, 1 Drawing Figure

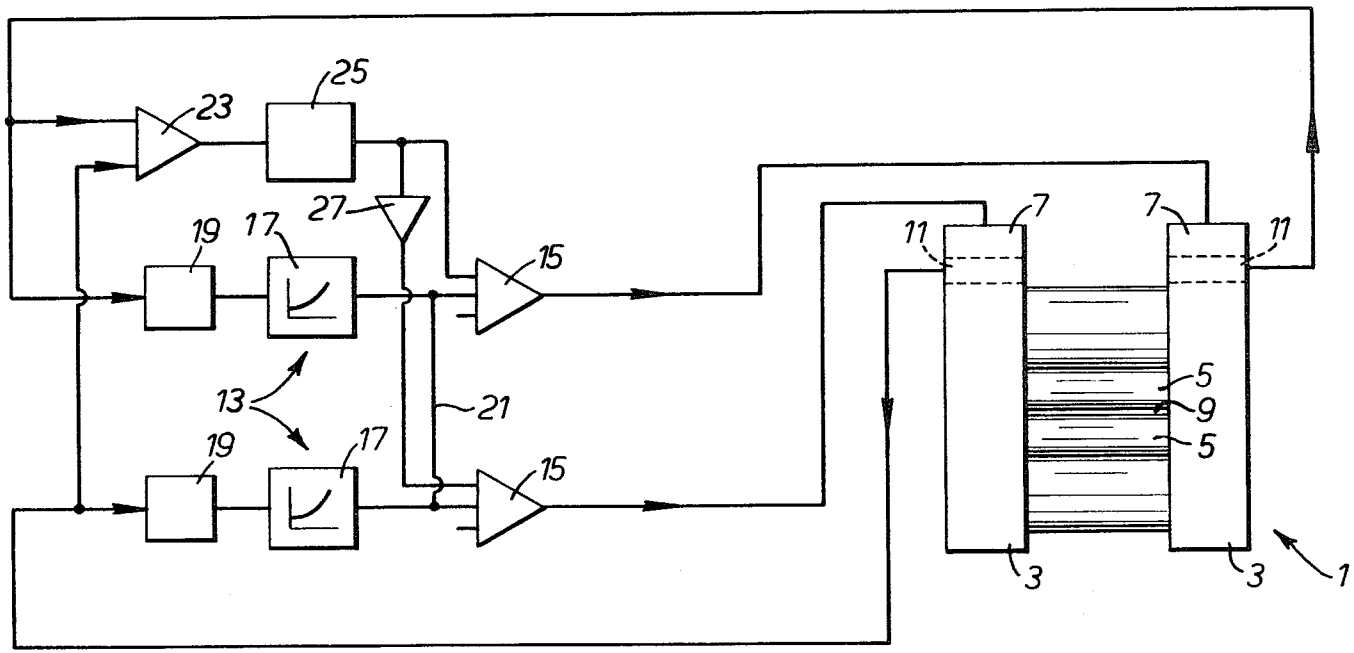
1
3
3
5
5
9
7
7
11
11
15
15
21
25
27
17
17
13
19
19
23

ROLLING MILL CONTROL SYSTEM

FIELD OF THE INVENTION

This invention relates to a control system for controlling the operation of a rolling mill so as to improve the tracking of material being rolled through the bite between the rolls of the mill.

BACKGROUND OF THE INVENTION

In the rolling of metal workpieces, the workpiece is passed between a pair of rolls of at least one rolling mill stand. It is usual to pass the workpiece either backwards and forwards through the same mill stand to gradually reduce the thickness of the workpiece or through a plurality of stands arranged in tandem. Particularly in the case of rolling metal strip, a plurality of stands in tandem are used and it will be appreciated that the speed of the strip material through the stands increases as the thickness of the material is reduced. Thus, at the last stand, the strip can be moving at a high speed. For efficient, trouble-free rolling, therefore, it is essential that the moving strip material passes between the rolls substantially centrally between the two mill housings of each mill stand. If this does not occur, and the material gradually moves from this central track towards one of the housings, then it can foul against stationary side guides and the like on the mill housings and cause damage both to the strip and to the mill structure.

It is well known for a rolling mill to be provided with a gauge control system which automatically controls the separation of the rolls of a mill stand to take into account the stretch of the housings as they come under load and also variations in temperature and hardness of the workpiece.

In a rolling mill fitted with a hydraulic cylinder in each housing to adjust the roll gap, the required gauge of the material to be rolled is set by positioning the rolls which form the roll gap and the load on each housing, during rolling, is measured by a separate transducer. These signals are modified by shaping and scaling circuits to represent the stretch of each mill housing and are fed back to the position control loop associated with each housing in such a sense as to make the hydraulic cylinders compensate for the mill stretch. By controlling the magnitude of the signals which are fed back to each position control loop, the apparent stiffness of the mill can be increased from natural stiffness with zero stretch signal feedback to infinitely stiff where the stretch signal fully compensates for the actual stretch of the mill.

The rolls of a rolling mill are eccentric to some degree and, while modern rolls are made to high tolerances, there is always some degree of eccentricity between the rolls when they are fitted in their bearings in the mill housings. If the gauge control circuit is operating such that the apparent stiffness of the mill is approaching infinity, then the effect of the roll eccentricity is imprinted on the strip material being rolled and the gauge of the strip varies cyclically along its length. With a softer mill housing, this eccentricity effect is less pronounced.

OBJECTS OF THE INVENTION

It is an object of the present invention to provide a control circuit for controlling the operation of a rolling mill to improve the tracking of the workpiece being rolled.

It is a further object of the present invention to provide a control circuit for controlling the operation of a rolling mill having a hydraulic cylinder in each housing so as to improve the tracking of the workpiece being rolled.

SUMMARY OF THE INVENTION

According to the present invention, a control system for a rolling mill having a pair of housings, at least two rolls supported at their ends in the housings and a pair of hydraulic cylinders associated one with each of the housings to vary the gap between the rolls comprises a pair of circuits for controlling the operation of the respective cylinders, means for producing signals representative of the load on respective housings, means by which the average of said signals is supplied to each of said control circuits and means for determining the difference (if any) of said signals and for producing a further signal representing said difference, said further signal being supplied to one of said control circuits and a signal of equal amplitude, but of opposite polarity, to said further signal being supplied to the other control circuit in order to increase the load on the heaviest loaded housing and to reduce the load on the lightest loaded housing.

BREIF DESCRIPTION OF THE DRAWINGS

In order that the invention may be more readily understood, it will now be described, by way of example only, with reference to the accompanying drawing which shows diagrammatically a control system for a rolling mill.

DESCRIPTION OF THE PREFERRED EMBODIMENT

A rolling mill 1 which is suitable for rolling a metal workpiece, such as aluminium strip, has two spaced apart housings 3 which rotatably support a pair of work rolls 5. Each housing includes a hydraulic cylinder in the form of a capsule 7 which acts between a fixed part of the housing and a bearing chock of one of the rolls to adjust the position of the roll and thereby adjust the roll gap 9. Some form of device for measuring the load applied to each housing is provided in each housing. This may take the form of a load cell or a transducer 11 which produces an electrical signal representative of the pressure of the hydraulic fluid supplied to the capsule.

Each housing has a control circuit 13 associated with it. Each circuit 13 is basically to automatically control the gauge of material rolled in the mill and comprises a summing amplifier 15, a scaling circuit 17, and a back-lash generator 19. A signal from the transducer 11 representing the load on the housing is modified slightly by the back-lash generator 19 to take into account the stiction or static friction present in the hydraulic capsule 7 and the signal is applied to the scaling circuit 17. In this circuit is stored information representing the stretch of the mill housing. The stretch-load relationship is not linear and is based on the results of tests on the mill housing. The signal applied to the circuit represents the load on the housing and the output of the circuit represents the stretch of the housing. The output is applied to one input of the summing amplifier 15. Another input receives a signal representing the required gauge of the workpiece. The output of the amplifier serves to control the hydraulic cylinder in the housing to position the end of the roll in the housing. Under normal rolling conditions, with the workpiece substantially centrally in the roll bite 9, the load on the two housings is substantially the same. If the temperature of the ingoing workpiece changes, or if there is a change in the ingoing gauge of the workpiece, then the load on both housings change together and the capsules are controlled by the control circuits to bring about substantially constant gauge.

If the workpiece entering the mill tracks away from the centre of the mill towards one housing, then the load on that housing increases slightly and the load on the other housing reduces slightly. These changes in load are detected by the transducers 11 and signals are fed to the scaling circuit 17 where output signals are produced representing the mill stretch for the new loads. The summing amplifiers 15 cause the capsules 7 to be controlled so that the load on the housing, towards which the workpiece moves, is increased further and the load on the other housing is reduced further. However, the change in the signals from the amplifiers 15 are controlled by the mill stretch as determined by the scaling circuits 17 and the change in loads on the two housings is insufficient to cause the workpiece to be moved back to the central position of the roll bite.

The control circuit of the present invention is such as to include a connection 21 between the corresponding inputs of the two summing amplifiers 15. This means that the output signal from the scaling circuits 17 are equalised and the same signal is applied to both summing amplifiers. In other words, an average of the two outputs from the scaling circuits is obtained and the average value is supplied to each of the amplifiers. Furthermore, the two signals from the transducers 11 are supplied to a difference amplifier 23 which produces an output signal representing the difference between the loads on the two housings. The gain of the amplifier 23 is quite independent of the scaling circuit 17 and the output of the amplifier is passed via a dead-band filter 25 to an input of one of the amplifiers 15. The output of the dead-band filter is also passed by way of an inverter 27 to an input of the other amplifier 15. The purpose of the inverter 27 is to ensure that the inputs applied to the two amplifiers 15 are of the same magnitude but of opposite polarity. The dead-band filter 25 simply produces an output from which unwanted ripple has been removed. The output of the amplifier 23 is arranged such that the positive output is applied to the housing which has the heaviest load in order to increase the load, and the negative output is applied to the housing having the lightest load in order to reduce it. By suitably adjusting the gain of the amplifier 23, the magnitude of the signals applied to the amplifiers 15 is such as to change the loads on the housings sufficiently for the workpiece to be squeezed back on to its correct track through the centre of the mill.

An example of the operation of the rolling mill will now be given.

(a) Without the invention, a rolling mill is rolling metal strip and the load on each housing is 736 tons. It is found from tests that, for this load, each housing will stretch by 4.048 mm. To compensate 100% for this stretch, the scaling circuits are set and the hydraulic capsule in each housing is controlled to adjust the roll gap by 4.048 mm. The mill stretch is, thus, $$736/4.048 = 182 \text{ tons/mm.}$$

If the workpiece moves away from the centre of the mill towards one of the housings, the difference in load between the two housings is found to be 50 tons. It is reasonable to assume that one housing will now have a load of $736+25=761$ tons and the other will have a load of $736-25=711$ tons.

The two control circuits will attempt to squeeze the workpiece back to the centre of the mill, but the scaling circuits 17 have been set at 182 tons/mm and so the load on one housing will be increased to correspond to a mill stretch of $$761/182 = 4.18 \text{ mm}$$

and the load on the other housing will be reduced to $$711/182 = 3.90 \text{ mm}$$

In practice, it has been found that this difference in the roll gap of $4.18-3.90 \text{ mm} = 0.28$ mm is insufficient to cause the workpiece to be squeezed back to the centre of the mill.

(b) With the invention, a rolling mill is rolling metal strip and the load on each housing is 736 tons. It is found from tests, that for this load, each housing will stretch by 4.048 mm. To compensate 100% for this stretch, the scaling circuits are set and the hydraulic capsule in each housing is controlled to adjust the roll gap by 4.048 mm.

The mill stretch is thus $$736/4.048 = 182 \text{ tons/mm}$$

If the workpiece moves away from the centre of the mill towards one of the housings, the difference in load between the two housings is found to be 50 tons. It is reasonable to assume that one housing will have a load of 761 tons and the other will have a load of 711 tons.

However, the output of difference amplifier 23 represents 50 tons and the gain of this amplifier is adjusted until the workpiece is squeezed back to the centre of the mill. To do this, it was found that each capsule had to be moved by 0.28 mm so that the gap at one housing is changed to $4.048+0.28=4.328$ mm, while the gap at the other housing is changed to $4.048-0.28=3.768$ mm. The gain of amplifier 23 is quite independent of the output of scaling circuits 17 which is the common stiffness setting.

The difference between the two capsules giving a roll gap difference of 0.56 mm could not be obtained without the invention, unless the mill stretch was compensated for by more than 100%, that is, by adjusting the roll gap by an amount which is greater than the roll stretch, and this not only causes gauge errors in the rolled workpiece, it also accentuates the effect of the eccentricity of the rolls on the workpiece.

Although the control system has been described to operate a rolling mill to prevent tracking of the workpiece towards one or other of the housings, the system can be used in an alternative manner to solve a problem which sometimes occurs when rolling a metal workpiece. If the cross-section of the workpiece normal to its length is tapered then, as the workpiece leaves the rolling mill, it will "banana", that is, it will curve to one side. The reason for this is that a conventional automatic gauge control system would attempt to adjust the loads on the two housings in order to roll the workpiece flat.

This problem can be overcome by adjusting the output of the amplifier 23 of the circuit so that the positive output is supplied to the lightest load to increase it and the negative output is supplied to the heaviest load to reduce it. With this arrangement, the rolls of the mill are tilted so that the roll gap matches the cross-section of the incoming workpiece and the "banana" effect is avoided.

Obviously, many modifications and variations of the present invention are possible in light of the above teachings. It is therefore to be understood that within the scope of the appended claims, the present invention may be practiced otherwise than as specifically described herein.

What we claim as our invention and desire to secure by patent is:

1. A control system for a rolling mill having a pair of housings, at least two rolls supported at their ends within said housings with a gap defined between said rolls, and a pair of hydraulic cylinders respectively operatively associated with said pair of housings for varying said gap defined between said rolls, and said system comprising:

a pair of first circuits for respectively controlling said pair of hydraulic cylinders so as to control said gap defined between said rolls;

means for producing signals representative of the load exhibited within each of said pair of housings and for conveying said load signals to said pair of first circuits;

means interconnecting said pair of first circuits together for producing averaged output stretch signals from said pair of first circuits to said pair of hydraulic cylinders in response to said load signals; and differential circuit means connected to said load-signal producing means for providing differential output signals, of equal magnitude yet opposite polarity, to said pair of first circuits such that said differential output signals are processed by said pair of first circuits along with said averaged output stretch signals whereby composite output signals, comprising said averaged output stretch signals and said differential output signals, are conveyed to said pair of hydraulic cylinders so as to properly control said pair of hydraulic cylinders.

2. A control system as claimed in claim 1, in which the differential output signals are supplied directly to one of the control circuits and are supplied through an inverter to the other circuit.

3. A control system as claimed in claim 2, in which each of said first circuits includes means for compensating for stiction in the cylinder.

4. A control system as set forth in claim 3, wherein:

said compensating means comprises a back-lash generator.

5. A control system as set forth in claim 1, wherein:

said load-signal producing means comprises a load cell.

6. A control system as set forth in claim 1, wherein:

said load-signal producing means comprises a transducer.

7. A control system as set forth in claim 1, wherein:

said differential circuit means comprises a differential amplifier.

8. A control system as set forth in claim 1, wherein:

said means interconnecting said pair of first circuits together comprises a pair of scaling circuits respectively disposed within said pair of first circuits for converting said load signals into said stretch signals.

9. A control system as set forth in claim 1 wherein:

said pair of first circuits further comprise summing amplifiers respectively disposed within each of said pair of first circuits for processing said averaged output stretch signals and said differential output signals so as to generate said composite output signals.

10. A control system as set forth in claim 9, wherein:

said each of said summing amplifiers includes an input signal, representative of the desired gauge of material to be processed within said rolling mill, for inclusion within said composite output signals conveyed to said pair of hydraulic cylinders.

11. A control system for a rolling mill having a pair of housings, at least two rolls supported at their ends within said housings with a gap defined between said rolls, and a pair of hydraulic cylinders respectively operatively associated with said pair of housings for varying said gap defined between said rolls in order to prevent tracking of a workpiece, being processed within said rolling mill, towards one of said housings, said system comprising:

a pair of first circuits for respectively controlling said pair of hydraulic cylinders so as to control said gap defined between said rolls;

means for producing signals representative of the load exhibited within each of said pair of housings and for conveying said load signals to said pair of first circuits;

means interconnecting said pair of first circuits together for producing averaged output stretch signals from said pair of first circuits to said pair of hydraulic cylinders in response to said load signals; and differential circuit means connected to said load-signal producing means for providing differential output signals, of equal magnitude yet opposite polarity, to said pair of first circuits such that said differential output signals are processed by said pair of first circuits along with said averaged output stretch signals whereby composite output signals, comprising said averaged output stretch signals and said differential output signals, are conveyed to said pair of hydraulic cylinders in such a manner as to increase the load upon the heavier-loaded housing of said pair of housings and to decrease the load upon the lighter-loaded housing of said pair of housings so as to achieve the proper tracking of said workpiece within said rolling mill.

12. A control system for a rolling mill having a pair of housings, at least two rolls supported at their ends within said housings with a gap defined between said rolls, and a pair of hydraulic cylinders respectively operatively associated with said pair of housings for varying said gap defined between said rolls in order to prevent abnormal effects from being generated within a workpiece, having a tapered cross-section as viewed normal to its length, being processed within said rolling mill, said system comprising:

a pair of first circuits for respectively controlling said pair of hydraulic cylinders so as to control said gap defined between said rolls;

means for producing signals representative of the load exhibited within each of said pair of housings and for conveying said load signals to said pair of first circuits;

means interconnecting said pair of first circuits together for producing averaged output stretch signals from said pair of first circuits to said pair of hydraulic cylinders in response to said load signals; and differential circuit means connected to said load-signal producing means for providing differential output signals, of equal magnitude yet opposite polarity, to said pair of first circuits such that said differential output signals are processed by said pair of first circuits along with said averaged output stretch signals whereby composite output signals, comprising said averaged output stretch signals and said differential output signals, are conveyed to said pair of hydraulic cylinders in such a manner as to increase the load upon the lighter-loaded housing of said pair of housings and to decrease the load upon the heavier-loaded housing of said pair of housings so as to achieve proper processing of said workpiece within said rolling mill.

* * * * *